US011378369B1

(12) United States Patent
Manley et al.

(10) Patent No.: US 11,378,369 B1
(45) Date of Patent: Jul. 5, 2022

(54) MODULAR TEST VEHICLE

(71) Applicant: U.S. Government as Represented by the Secretary of the Army, Dover, NJ (US)

(72) Inventors: David Chalfant Manley, Budd Lake, NJ (US); Thomas Emanski, Great Meadows, NJ (US); James Grassi, Rockaway, NJ (US); Jason Wasserman, Oak Ridge, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 335 days.

(21) Appl. No.: 16/556,819

(22) Filed: Aug. 30, 2019

(51) Int. Cl.
*F42B 35/00* (2006.01)
*F42B 14/02* (2006.01)

(52) U.S. Cl.
CPC ..... *F42B 35/00* (2013.01); *F42B 14/02* (2013.01)

(58) Field of Classification Search
CPC ..... F42B 35/00; F42B 14/02
See application file for complete search history.

(56) References Cited

U.S. PATENT DOCUMENTS 50,357 A * 10/1865 Hotchkiss ..... F42B 14/02 102/525
160,071 A * 2/1875 Arrick ..... F42B 14/02 102/525
1,756,079 A * 4/1930 Anderson ..... F42B 5/38 102/439
2,727,464 A * 12/1955 Perlin ..... F42B 12/204 102/439
4,211,168 A * 7/1980 Haep ..... F42B 8/12 102/444
4,307,666 A * 12/1981 Baran ..... F42B 14/02 102/501
4,671,179 A * 6/1987 Synofzik ..... F42B 5/073 102/430
5,020,438 A * 6/1991 Brown ..... F42B 10/04 102/436
5,160,804 A * 11/1992 Wahner ..... F42B 5/16 102/443
7,418,906 B2 * 9/2008 Brislin ..... F42B 12/64 102/494
7,581,501 B1 * 9/2009 Boone ..... F42B 10/06 102/214
7,600,421 B1 * 10/2009 Hollis ..... F42B 12/365 102/510
8,250,987 B1 * 8/2012 Morley ..... F42B 10/48 102/506

(Continued)

*Primary Examiner* — Michelle Clement
(74) *Attorney, Agent, or Firm* — Michael C. Sachs

(57) ABSTRACT

A modular constructed, standardized test device for simulating a spin stabilized projectile which is fired from a barrel having rifling grooves, comprised of the bolted together, keyed to transfer spin, modular components of replaceable rotating band, replaceable front end and back end, and filler sections for further simulation of other components. The front end has an interior recessed area which allows for a selective integration of a threaded fuze or an aerodynamic, electronic, or other structure and the rear end has a crimp groove for selective attachment of a cartridge case, and aerodynamic or other structure to mimic the rear geometry of a projectile for testing purposes.

4 Claims, 3 Drawing Sheets

(56) References Cited

U.S. PATENT DOCUMENTS

| | | | | |
|---|---|---|---|---|
| 8,844,444 | B1 * | 9/2014 | Hooke | F42B 35/00 102/502 |
| 2008/0196616 | A1 * | 8/2008 | Cziglenyi | F42B 30/02 102/439 |
| 2009/0133310 | A1 * | 5/2009 | Wossner | F41A 21/10 42/77 |
| 2011/0155014 | A1 * | 6/2011 | Marx | F42B 14/02 102/517 |
| 2014/0013986 | A1 * | 1/2014 | Mendes | F42B 27/08 102/487 |
| 2015/0033973 | A1 * | 2/2015 | Harvey | B21C 23/186 102/501 |
| 2017/0084889 | A1 * | 3/2017 | Miller, Jr | H01M 6/42 |
| 2019/0204054 | A1 * | 7/2019 | Heiche | F42B 35/00 |
| 2020/0064110 | A1 * | 2/2020 | Bourdillon | F42B 10/02 |
| 2021/0254954 | A1 * | 8/2021 | Billings | F41A 21/12 |

* cited by examiner

MODULAR TEST VEHICLE

U.S. GOVERNMENT INTEREST

The inventions described herein may be made, used, or licensed by or for the U.S. Government for U.S. Government purposes.

BACKGROUND OF INVENTION

During design and testing of projectiles it is common to create a test vehicle to shoot as a representative projectile. Such test vehicles can be used as carriers to test fuze components, to test the aerodynamics of the round, to test cartridge case functionality, and to test many other features of a round. Overall, a test vehicle is an inert projectile which has a mass, center of gravity, and moments of inertia which are very similar to the actual round in order to act as a realistic simulator. These rounds are often intended to help gather data while reducing cost, since they are often a more simple projectile than the actual real round, although, the real projectile can be inertly loaded and used as a test vehicle as well. Usually test vehicles are not recovered, however, test vehicles can be soft caught in order to be recovered, in soft catching systems.

Medium caliber munitions (20 MM to 60 MM) as an example are fired from a rifled barrel. As the projectile travels down the barrel the rotating band (or driving band or obturator) which is incorporated onto the projectile, engages the barrel rifling. This imparts spin to the round, which in turn gives stability to the round during flight. Because the projectile's rotating band is engraved during firing, a projectile typically cannot be re-fired; it must have a new, unused rotating band. This is an insurmountable fact holding back serial reuse of a test device, and an entire new test vehicle needs to be used for the next shot. As a result the entire test vehicle is a one-time use system and a whole new test vehicle has been needed to be used for each test shot. This typically results in a significant cost due to the amount of assets needed for testing. Clearly, an improvement is needed to greatly lower costs, and to make reuse of a test vehicle routinely possible whereas hitherto it has not been feasible.

BRIEF SUMMARY OF INVENTION

The invention solves the above mentioned and other problems by having a rapidly replaceable, low cost rotating band; this helps to drastically reduce the cost of testing. The invention reduces the amount of waste produced from each test shot, for instance when used in conjunction with a soft catch system, to catch and recover a test projectile with no damage in a water filled system e.g. As a result, the only cost incurred after the initial cost of purchasing the test vehicle assemblies, would be the cost of the replacement rotating bands, which are relatively inexpensive. This allows for the firing of more projectiles, and more rapidly, and at a much lower cost. This results in increasing the possible amount of data recorded, while decreasing the cost of hardware for testing.

OBJECTS OF THE INVENTION

Accordingly, it is an object of the present invention to provide a modular constructed, standardized test device for simulating a spin stabilized projectile for developmental or other test purposes.

Another object of the present invention is to provide a modular constructed, standardized test device for simulating a spin stabilized projectile wherein the test device features an easily replaceable inexpensive rotating band component for rapidly repeatable low cost tests.

It is a further object of the present invention to provide a modular constructed, standardized test device for simulating a spin stabilized projectile wherein the test device features an easily replaceable inexpensive front end component having a recess area which allows for a selective integration of a threaded fuze for rapidly repeatable low cost tests.

It is yet another object of the present invention to provide a modular constructed, standardized test device for simulating a spin stabilized projectile wherein the test device features an easily replaceable inexpensive rear end component having a crimp groove for selective attachment of a simulated cartridge case to mimic the rear geometry of a projectile for testing purposes.

It is a still further object of the present invention to provide a modular constructed, standardized test device for simulating a spin stabilized projectile wherein the test device features an easily replaceable inexpensive filler component for simulating moments of inertia, mass, or center of gravity, for rapidly repeatable low cost tests.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
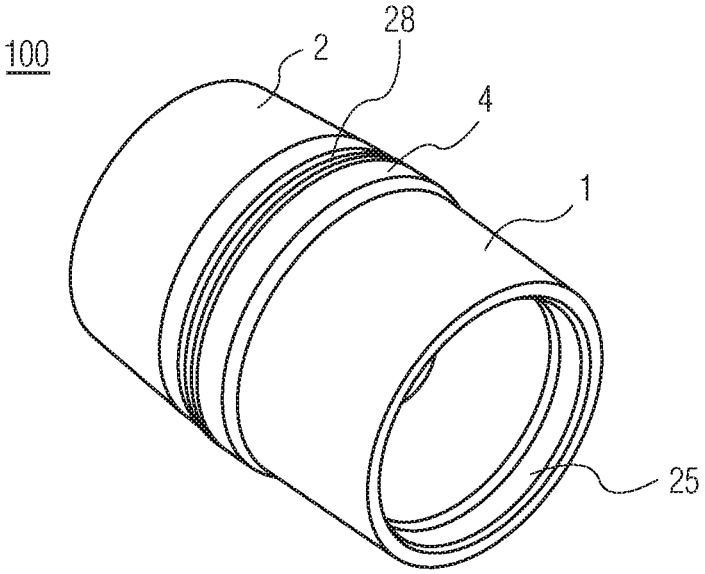
FIG. 1 is a left side isometric view of an assembled test vehicle according to the invention, which is used to simulate the flight of a spin stabilized projectile for development testing purposes.
Figure 2:
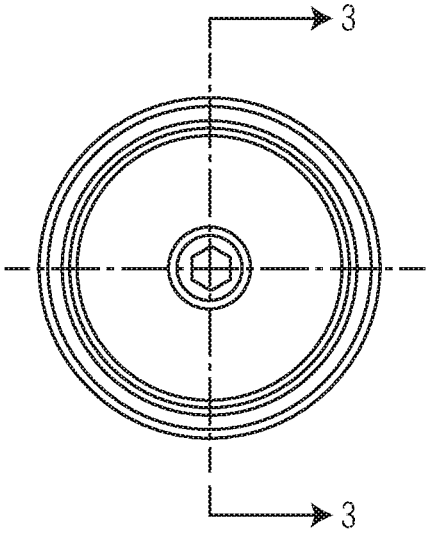
FIG. 2 is a front view of the assembled test vehicle device according to this invention.
Figure 3:
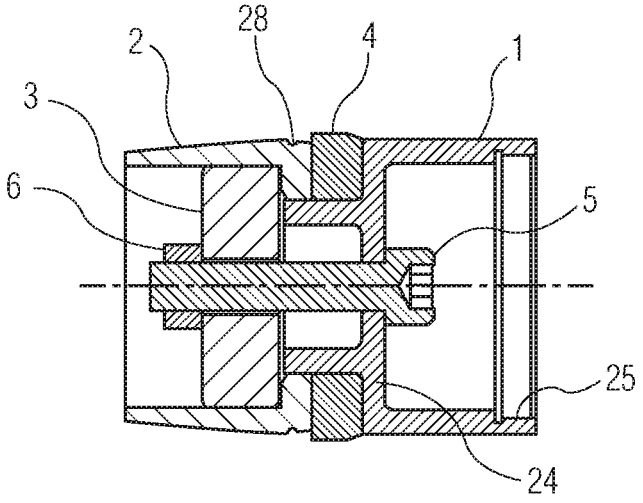
FIG. 3 is a cross sectional view of the assembled test vehicle device along section lines A-A as shown in the front view of FIG. 2, according to this invention.
Figure 4:
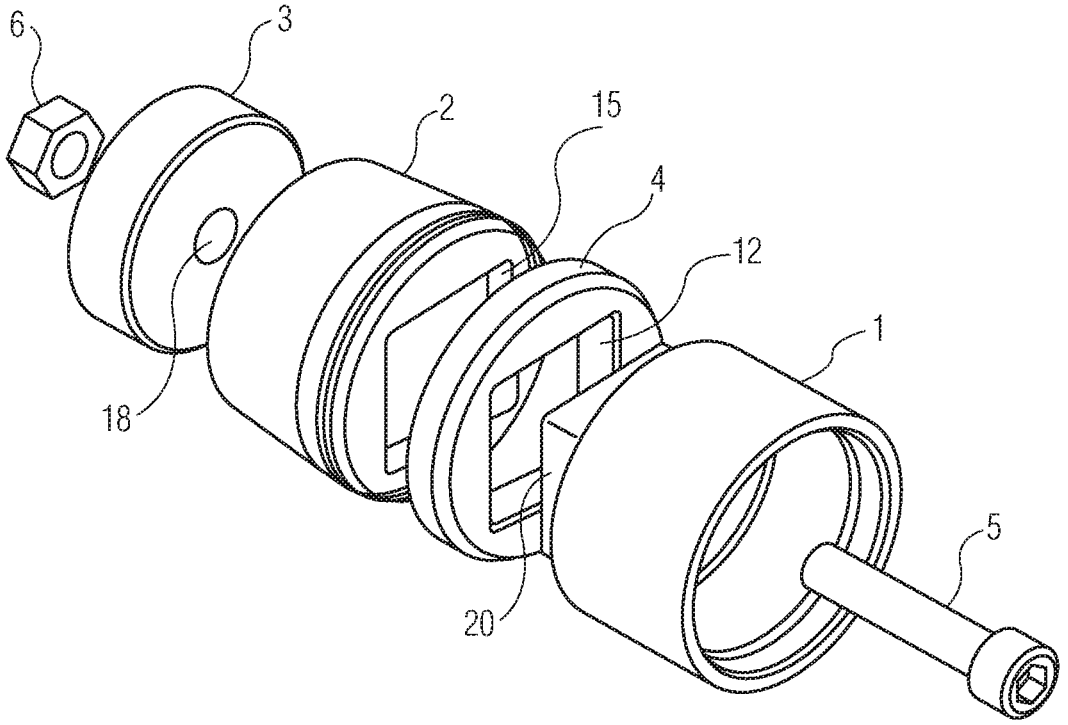
FIG. 4 is an exploded view of the assembled test vehicle modular parts in position, according to this invention.
Figure 5:
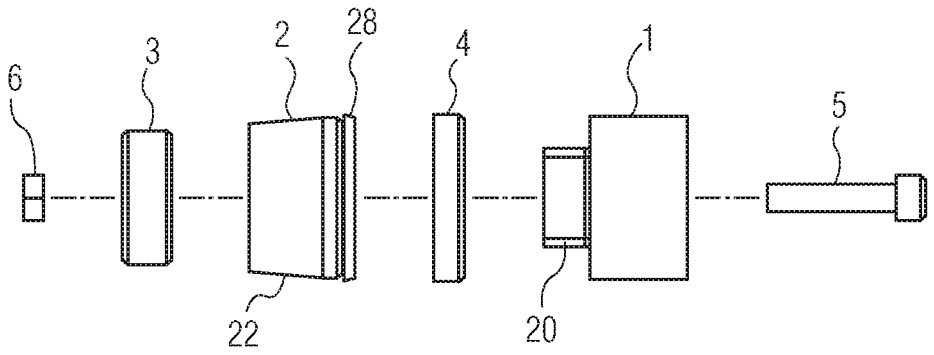
FIG. 5 is a cross sectional view of the FIG. 4 exploded view of the assembled test vehicle modular parts in position, according to this invention.

FIGS. 1-6 show an embodiment of the invention which will solve the previously mentioned hurdles. One of the most useful advantages of this invention is the ability to replace the rotating band simulator (part 4 in the figures) with ease, and with little time or expense. Since the rotating band is engraved it cannot be reused, and results in the entire projectile being totally spent during the firing, which is the chief expense. A previously known test vehicle which could be reused required machining a new rotating band, and swaging it onto a one piece projectile body. But swaging on a new rotating band is a major project. It requires heavy machines, a skilled machinist, limits materials which can be used, limits results, is time consuming, causes the old rotating band to be cut off, and putting on each new band is expensive every single time. This invention however, seeks to create a modular projectile with a simple fastening mechanism which allows for the rapid replacement of the rotating band without the need for presses and other equipment. This advantage allows the user to replace the rotating band more easily and while at the testing location. This invention also allows for the use and testing of a more broad range of rotating band materials since they do not need to be swaged on. It reduces the amount of waste produced from each test shot, for instance when used in conjunction with a soft catch system, to catch and recover the test projectile with no damage in a water filled system e.g. As a result the only cost incurred, after the initial cost of purchasing the test vehicle assemblies, is the cost of the replacement rotating bands part number 4, which are relatively inexpensive.

The replaceable rotating band invention has many applications, a few of which will be described below. One application that this design was created for was electronic fuze testing. In an effort to create smart electronic fuzes for medium caliber munitions an OBR, or On-Board Recorder, can be used to record the functions of the electronic fuze in order to provide information on how the fuze is functioning during flight. The fuze and OBR are attached to a test vehicle and then the assembly is fired from the weapon and "soft caught" for recovery. Next, data from the OBR is downloaded. The OBR used can be re-fired to gather more data, however, traditionally the test vehicle could not be reused since the rotating band was engraved during firing. With previous technology this meant that a whole new test vehicle needed to be used for the next shot. Now, only the rotating band 4 needs to be replaced and all other components can be reused generating a significant cost reduction.

This invention can also be used as a platform to aid in testing the aerodynamics of a projectile in a modular manner. For example, different tail and front section geometries, parts 1 and 2, (see FIGS. 3 and 4 e.g.), can be tested by simply swapping out the relative section of the round with another part featuring an aerodynamic change. This makes the geometry modular, adding to the ability to test varying concepts with fewer components being built. In addition to this, such projectiles can also be re-tested by replacing the rotating band, once again reducing testing costs and increasing the amount of data that can be recorded.

Another application of this design would be to allow for the study of alternate rotating band configurations. Rotating bands of differing materials could be tested with this design in order to assess how they perform while engaging the rifling of the barrel. This would allow for a cost effective way to test many types of rotating band configurations by using the same test vehicles and simply replacing the rotating bands.

Further applications which this technology has been used for are in cartridge case testing. There are many tests which need be performed such as testing new cartridge case geometry, new crimping methods, new propellants, new primers, new cartridge case materials and many other aspects. While testing these components it is necessary to fire projectiles from the cartridge cases. This replaceable rotating band technology allows for a significant reduction to the cost of testing these cartridge cases since the engineer only needs to procure rotating bands, and does not need to fabricate whole test vehicles to test cartridge cases. In addition to this the invention allows for the user to replace the rotating band more quickly than swaging on a new band, decreasing the testing time.

In addition to the applications mentioned, this technology can potentially be applied to other munitions which feature a rotating band, and to other testing scenarios where test vehicles are utilized.

Figure 6:
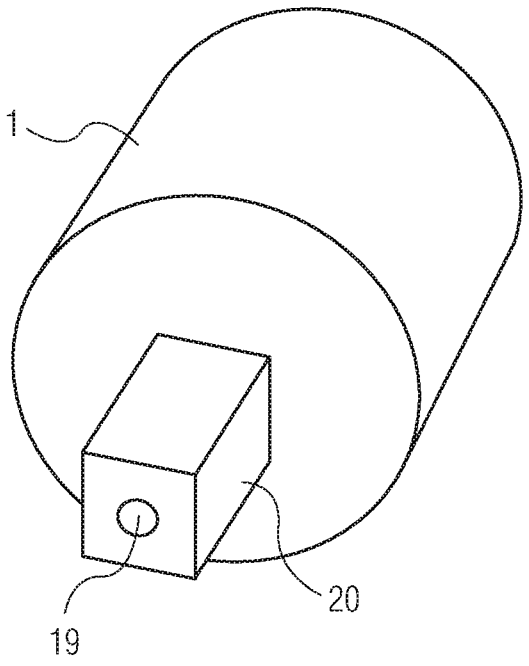
FIG. 6 is a right looking isometric drawing of the posterior side of part 1 front end of a projectile test vehicle according to this invention.

As seen in the drawings attached, FIGS. 1-6, there are six parts in the assembly. Part number 1 is the simulator projectile front. This part acts to mimic the front section of the projectile. In addition to this, part 1 has recessed area 25 which allows for the integration of a threaded fuze, and also keys into parts 2 and 4 to be explained, to ensure that the entire round spins as one assembly. Part number 2 is intended to mimic the rear geometry of the projectile. This section features a crimp groove 28 to attach a cartridge case, and also contains geometry to allow it to key into the front part labeled number 1. Parts 1 and 2 are essentially hollow cylindrically shaped, while part 1 has a back wall 24 which also holds on rectangular keying part 20 to be further explained, Part 3 is a filler piece intended to create a chamber volume more similar to that of the actual projectile in a cartridge case. This helps to ensure that the simulator will have a velocity and propellant pressure similar to the actual projectile, Part 4 is the replaceable rotating band. This part engages the rifling allowing the rotating band to spin; it also keys into part 1 in order to transfer this spin to the entire test vehicle assembly. For projectiles that do not engage the rifling (not wide enough or wide enough rotating band), part 4 can act as an obturator to provide an in-bore seal. This part 4 can be removed and replaced as described previously after each test shot. Parts 5 and 6 consist of a bolt and nut which holds the other pieces of the assembly in compression so that the entire assembly acts as if it is one piece. As shown in FIG. 6, part 1 has a rear attached rectangular assembly 20 which is sized so that it keys into rectangular space 12 in rotating band 4 and into rectangular space 15 in rear end part 2, so that at least parts 1, 4 and 2 all rotate together as one unit. Assembly 20 has a through hole 19 so that all the parts 1, 2, 3, and 4 can be bolted together by threaded hex cap bolt 5 and closed by nut 6 as shown in exploded view FIG. 4, e.g. Many other geometric shapes for the keying other than rectangular are possible and other arrangements so that at least parts 1, 4 and 2 may all rotate together as one unit. In addition, the parts can be attached to one another through alternate means than the use of a bolt and nut.

As mentioned previously the geometry of part number 1, 2, 3 and 4 can all be changed in order to mimic an intended projectile, and to test various geometries for aerodynamic effects. In addition to this, other fastening features can be used if the projectile geometry is changed. This design can also be adapted to work with other caliber munitions.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A modular constructed, standardized test device (100) for simulating a spin stabilized projectile which is fired from a barrel having rifling grooves, said test device comprises:

a replaceable rotating band (4), a replaceable front end (1), a replaceable rear end (2), a filler piece (3), a bolt (5), and a nut (6) and wherein the replaceable front end (1) has a posterior rectangular box protrusion (20) with a through hole (19) for the bolt (5), and wherein the replaceable rotating band (4) and replaceable rear end (2) each have rectangular cut out areas that are sized to be engaged by said rectangular box protrusion so that the replaceable front end, replaceable rotating band and replaceable rear end are all keyed together to transfer spin there between, and wherein said filler piece (3) has a through hole (18) to receive the bolt and wherein the bolt is tightened with the nut (6) at posterior of said filler piece so that the test device is bolted together as a unitary assembly.

2. The test device of claim 1 wherein the replaceable front end (1) has an interior recessed area (25) which allows for a selective integration of a threaded fuze or an aerodynamic or electronic structure for testing purposes.

3. The test device of claim 2 wherein the replaceable rear end (2) has a crimp groove (28) for selective attachment of a cartridge case and aerodynamic structure to mimic the rear geometry of a projectile for testing purposes.

4. The test device of claim 3 wherein one may simulate a variation in: mass, center of gravity, and moments of inertia, alternate materials, sizing, spacing, positioning, dimensioning, or tolerancing, by rapid replacement in any of the modular components.

* * * * *